United States Patent [19]

Ferns

[11] Patent Number: 4,483,110

[45] Date of Patent: Nov. 20, 1984

[54] METHODS OF INSTALLING FRAMES FOR ACCESS PITS AND MANHOLES

[75] Inventor: Derek Ferns, Trelleck, Wales

[73] Assignee: Selflevel Covers (Jersey) Limited, Jersey, Channel Islands

[21] Appl. No.: 440,434

[22] Filed: Nov. 9, 1982

[30] Foreign Application Priority Data

Nov. 10, 1981 [GB] United Kingdom ..... 8133880

[51] Int. Cl.[3] ..... E02D 29/14

[52] U.S. Cl. ..... 52/20; 404/25

[58] Field of Search ..... 52/20, 474; 404/25; 49/463–466, 504

[56] References Cited

U.S. PATENT DOCUMENTS 3,521,537 7/1970 Forni ..... 52/20 X 4,266,380 5/1981 Samolis ..... 404/25 X

FOREIGN PATENT DOCUMENTS 569762 of 1945 United Kingdom ..... 404/25

1556354 11/1979 United Kingdom ..... 52/20

*Primary Examiner*—J. Karl Bell

*Attorney, Agent, or Firm*—Young & Thompson

[57] ABSTRACT

In order to span an access pit or manhole having a clear opening of relatively large area, one or more I-section steel beams are laid across the opening so as to divide the area to be covered into a number of smaller areas. One or more frame members, each of which is shaped so as to support parts of two covers or gratings which are adjacent and on opposite sides of the associated beam, are then positioned directly above the center line of the or each beam and bolted to the beam. Finally the areas between the or each beam and the sides of the pit or manhole, and between the beams themselves, are covered by covers or gratings supported by the frame members. Such an arrangement ensures that eccentric loading of the beams does not occur under heavy loading conditions.

8 Claims, 3 Drawing Figures

METHODS OF INSTALLING FRAMES FOR ACCESS PITS AND MANHOLES

BACKGROUND OF THE INVENTION

This invention relates to methods of installing frames for access pits and manholes, and more particularly frames for supporting multiple covers or gratings above such pits or manholes.

Where an access pit or manhole having a clear opening of relatively large area is to be provided with a multiple-cover arrangement capable of withstanding heavy loads, it is conventional practice to span the opening by means of one or more I-section steel beams (rolled steel joists) so as to divide the area to be covered into a number of smaller areas. Each of these smaller areas is then covered by a number of covers disposed side by side, each cover extending between two adjacent beams, or between a beam and the adjacent wall of the pit, and being supported at its ends by parallel frame members, at least one of which is supported on the upper surface of a beam. Where two covers are positioned symmetrically on either side of the centre line of a supporting beam, the beam carries a separate frame member for each cover, the two frame members being supported by the two upper flanges respectively of the beam. There is normally a gap between the two adjacent frame members which is filled with concrete in order to increase the rigidity of the structure.

However, where such covers are to be subjected to high loads, for example in docks, airports and general heavy traffic areas, the upper flanges on the beam may become deformed by excessive loading of the frames. This may result in the beams becoming eccentrically loaded leading possibly to failure of the beams.

It is an object of the invention to obviate these disadvantages by using an entirely novel installation method which ensures that eccentric loading of the beams does not occur under heavy loading conditions.

SUMMARY OF THE INVENTION

According to the invention there is provided a method of installing frames for supporting multiple covers or gratings above an access pit or manhole, comprising spanning the clear opening of the pit or manhole by means of at least one support beam so as to divide the total clear area into smaller areas each of which is to be covered by a number of separate covers or gratings, and laying on the or each support beam one or more frame members each of which is shaped so as to support parts of two covers or grating which are adjacent and on opposite sides of the beam.

Where the support beam is of I-section, the longitudinal axis of the frame member should be positioned directly above the centre line of the beam, so that forces acting on the frame member are transmitted vertically downwards through the centre line so that the support beam is symmetrically loaded at all times, even under heavy loading conditions.

Advantageously a frame member is used having two inclined seating faces on opposite sides of the member each of which is intended to engage a correspondingly inclined face on a respective one of the adjacent covers or gratings to support said cover or grating. These inclined seating faces serve to distribute the load along the frame member.

Furthermore the frame member preferably includes two seating blocks at opposite ends of the member each of which has an angled seating face facing in the general direction of the opposite end of the member and intended to engage correspondingly angled faces on the adjacent covers or gratings.

The invention also provides a multiple cover or grating installation above an access pit or manhole, in which at least one support beam spans the clear opening of the pit or manhole so as to divide the total clear area into smaller areas each of which is covered by a number of separate covers or gratings, and one or more frame members rest on the or each support beam, and are each shaped so as to support parts of two covers or gratings which are adjacent and on opposite sides of the beam.

The invention includes within its scope a frame member for use in methods or installations according to the invention, as hereinbefore described.

BRIEF DESCRIPTION OF THE DRAWINGS

In order that the invention may be more fully understood, two installations in accordance with the invention will now be described, by way of example, with reference to the accompanying drawings, in which.

DETAILED DESCRIPTION OF THE DRAWINGS

Figure 1:
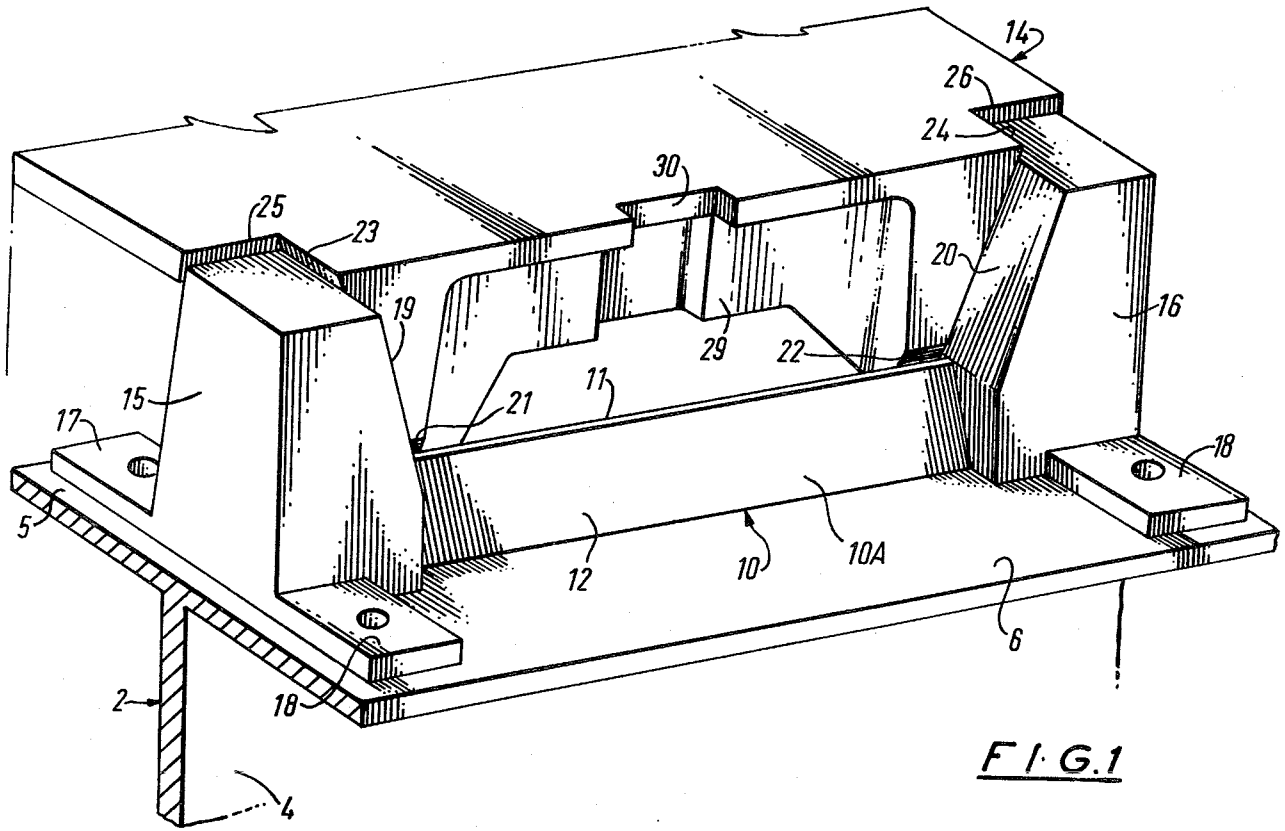
FIG. 1 is a perspective view of a frame member and cover on a support beam in a first installation.
Figure 2:
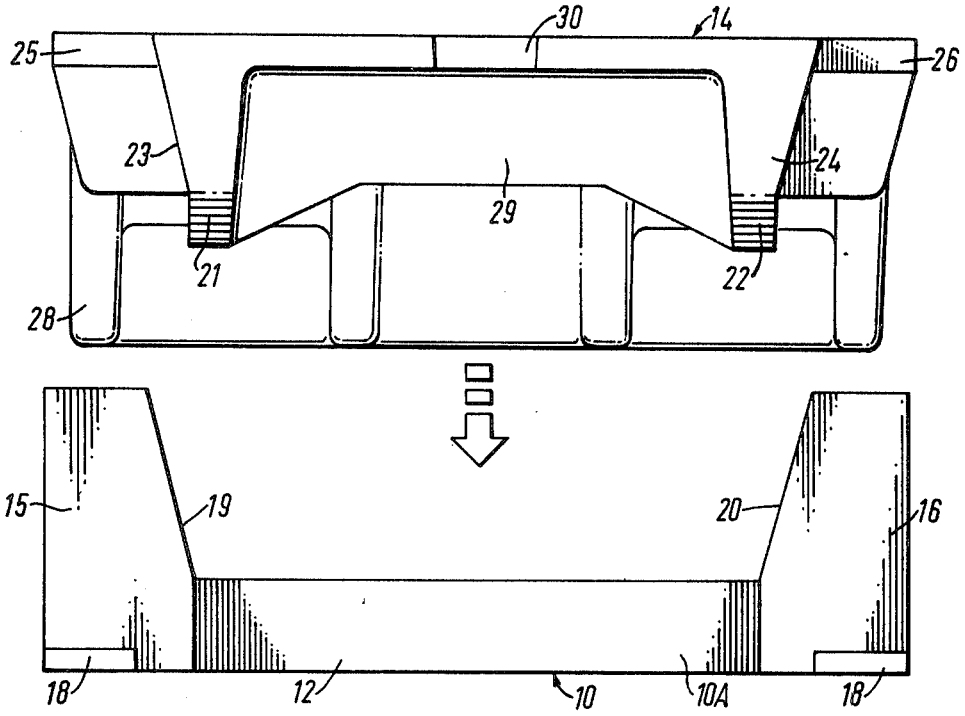
FIG. 2 is a view of the frame member and cover of FIG. 1 from one side, prior to fitting of the cover.

Referring to FIG. 1 the support beam 2 is a rolled steel joist (RSJ) of I-section and includes a central support web 4, upper flanges 5 and 6 and lower flanges (not shown). Referring also to FIG. 2, the frame member 10 has two inclined seating faces 11 and 12 each of which is provided for supporting a respective one of two adjacent covers such as 14. The frame member 10 also includes at its ends two seating blocks 15 and 16 each of which is provided with two flanges 17 and 18 which are attached to the support beam 2 by bolts (not shown). The seating blocks 15 and 16 have angled seating faces 19 and 20 each of which provides support for both of the adjacent covers such as 14.

The covers are shaped so that, when they are engaged with the frame member 10, the edges of the covers are substantially contiguous. Each cover is provided with inclined faces 21 and 22 for engaging with one of the inclined seating faces 11 or 12 on the frame member 10. The cover 14 is shown slightly raised in FIG. 1 so that these faces 21 and 22 are visible. In addition each cover is provided with angled faces 23 and 24 for engaging with the angled seating faces 19 and 20 on the seating blocks 15 and 16 of the frame member 10. Both covers also incorporate re-entrant corners 25 and 26 for accommodating the seating blocks 15 and 16, numerous strengthening ribs such as 28 and 29, and a recess 30 for enabling the cover to be lifted.

Where a pit or manhole having a clear opening of relatively large area is to be covered by such an arrangement, the opening is spanned by a number of support beams arranged parallel to one another and spaced apart by a distance corresponding to the lengths of the covers. Frame members such as 10 for supporting the covers are then laid end to end along the beams and bolted to the beams. Finally the covers are disposed side by side in rows between the beams so that each cover is supported by a respective frame member at each of its ends and adjacent covers in the same row abut each other along their sides. Adjacent covers in adjacent rows are both supported by the same double-sided frame member.

Figure 3:
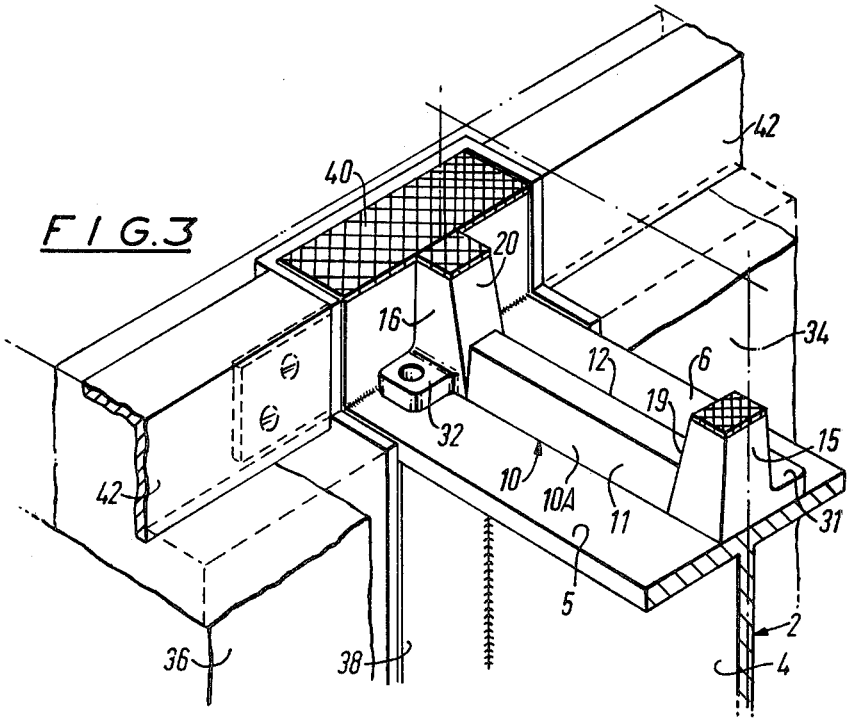
FIG. 3 is a perspective view of a frame member on a support beam in a second installation.

In the installation shown in FIG. 3 the frame member 10 is slightly different in construction to the frame member of FIGS. 1 and 2. In particular each seating block 15 or 16 is provided with only a single flange 31 or 32, and the flange 31 on the seating block 15 extends from one side of the frame member 10 whilst the flange 32 on the seating block 16 extends from the other side of the frame member 10. The frame member 10 is fixed to the support beam 2 by means of bolts (not shown) passing through the flanges 31 and 32 so that its longitudinal axis lies directly above the centre line of the beam 2 and in particular so that the longitudinal axis of the frame member 10 lies in a vertical plane 34 within which the support web 4 of the beam 2 extends.

The support beam 2 spans the clear opening of a pit 36 and is welded at each end to a thick stiffening plate 38 and a wall box 40 fixed to the side of the pit 36. In addition angle side frame members 42 are attached to the edges of the pit 36 for supporting the sides of the covers closest to the sides of the pit.

In both embodiments described above with reference to the drawings the frame member is cast by the mono block process from spheroidal graphite iron. This enables the frame member to be cast to very high tolerances so that an accurate fit with the matching cover or grating (also made from spheroidal graphite iron) is ensured.

I claim:

1. A method of installing frames for supporting multiple covers or gratings above an access pit or manhole, comprising spanning the clear opening of the pit or manhole by means of at least one support beam so as to divide the total clear area into smaller areas each of which is to be covered by a number of separate covers or gratings, and laying on the or each support beam one or more frame members shaped so as to support parts of two covers or gratings which are adjacent and on opposite sides of the beam, the longitudinal axis of the or each frame member being positioned directly above the center line of the associated beam.

2. A method according to claim 1 wherein the or each support beam is of I-section having a central web, and the longitudinal axis of the or each frame member is positioned directly above the center line of said central web of the associated beam.

3. A method according to claim 1, wherein a frame member is used having two inclined seating faces on opposite sides of the member each of which is intended to engage one or more correspondingly inclined faces on a respective one of the adjacent covers or gratings to support said cover or grating.

4. A method according to claim 1, wherein a frame member is used having two seating blocks at opposite ends of the member each of which has an angled seating face facing in the general direction of the opposite end of the member and intended to engage correspondingly angled faces on the adjacent covers or gratings.

5. A multiple cover or grating installation above an access pit or manhole, in which at least one support beam spans the clear opening of the pit or manhole so as to divide the total clear area into smaller areas each of which is covered by a number of separate covers or gratings, and one or more frame members rest on the or each support beam and are shaped so as to support parts of two covers or gratings which are adjacent and on opposite sides of the beam, the longitudinal axis of the or each frame member being positioned directly above the center line of the associated beam.

6. An installation according to claim 5, wherein the or each support beam is of I-section having a central web, and the longitudinal axis of the or each frame member is positioned directly above the center line of said central web of the associated beam.

7. An installation according to claim 5, wherein the or each frame member includes two inclined seating faces on opposite sides of the member each of which is intended to engage one or more correspondingly inclined faces on a respective one of the adjacent covers or gratings to support said cover or grating.

8. An installation according to claim 5, wherein the or each frame member includes two seating blocks at opposite ends of the member each of which has an angled seating face facing in the general direction of the opposite end of the member and intended to engage correspondingly angled faces on the adjacent covers or gratings.

* * * * *